US006985115B2

(12) United States Patent
Chen et al.

(10) Patent No.: US 6,985,115 B2
(45) Date of Patent: Jan. 10, 2006

(54) AUTOMATIC ANTENNA FOR PORTABLE ELECTRONIC DEVICE

(75) Inventors: Rui-Hao Chen, Shenzhen (CN); Ming-Feng Ma, Shenzhen (CN); Xiao-Yu Tan, Shenzhen (CN); Chia-Hua Chen, Tu-cheng (TW)

(73) Assignee: FTH, Co., Ltd., (TW)

( * ) Notice: Subject to any disclaimer, the term of this patent is extended or adjusted under 35 U.S.C. 154(b) by 0 days.

(21) Appl. No.: 10/970,113

(22) Filed: Oct. 21, 2004

(65) Prior Publication Data

US 2005/0270239 A1 Dec. 8, 2005

(30) Foreign Application Priority Data

Jun. 2, 2004 (TW) ..... 93201659 U

(51) Int. Cl.
*H01Q 1/24* (2006.01)

(52) U.S. Cl. ..... 343/702; 343/901

(58) Field of Classification Search ..... 343/702, 343/895, 900, 901, 903, 902, 906; H01Q 1/24
See application file for complete search history.

(56) References Cited

U.S. PATENT DOCUMENTS 5,945,952 A * 8/1999 Davidson ..... 343/702
6,321,099 B1 * 11/2001 Norimatsu ..... 455/575.7
6,337,671 B1 * 1/2002 Lee ..... 343/901
6,573,868 B2 * 6/2003 Johnson et al. ..... 343/702
6,859,179 B2 * 2/2005 Chang ..... 343/702

FOREIGN PATENT DOCUMENTS

CN 99802898.3 4/2001

* cited by examiner

*Primary Examiner*—Hoanganh Le
(74) *Attorney, Agent, or Firm*—Morris Manning & Martin; Tim Tingkang Xia, Esq.

(57) ABSTRACT

An automatic antenna (100) for a portable electronic device includes a shaft (20), a hollow securing element (30), a sliding element (50) having a plurality of sliding arms (54) symmetrically disposed on an outer wall thereof, a hollow rotating element (60), a housing (80), and a spring (70) disposed between the rotating element and the housing. The securing element has a plurality of blocks (320) symmetrically disposed on an inner wall thereof. The blocks define a plurality of slots (3200) therebetween. The sliding element defines an end surface (56). The rotating element includes a peripheral cam portion (61). A plurality of projections (604) protrudes from a periphery of the cam portion. The shaft extends through the securing element, the sliding element, the rotating element, the spring, and the housing in that order. The sliding arms can slide within the slots, and the projections can slide in the slots.

23 Claims, 5 Drawing Sheets

AUTOMATIC ANTENNA FOR PORTABLE ELECTRONIC DEVICE

BACKGROUND OF THE INVENTION

1. Field of the Invention

The present invention generally relates to automatic antennas, and particularly to an automatic antenna for a handheld radiotelephone.

2. Prior Art

In recent times, communication terminals have been in great demand because of the widespread use of devices such as cellular phones and pagers for mobile communication. In wireless communication systems, wireless communication terminals transmit signals to base stations. The base stations relay the signals to intended recipient communication terminals all the time, regardless of whether the intended recipient communication terminals are in communication-waiting mode. Portable electronic devices such as mobile phones and cordless telephones generally transmit and receive signals by antenna, and antennas that are used in these devices are in great demand.

Automatic antennas for portable electronic devices can be divided into two categories: built-in antennas and built-out antennas. Built-out antennas are generally exposed outside of the portable electronic device. Built-in antennas are retained in a housing of the portable electronic device, and generally are not exposed out of the portable electronic device. With a built-in antenna, the overall length of the portable electronic device is reduced, and the radiation of magnetic fields is greatly decreased. However, the built-in antenna is subject to shielding phenomena, which can greatly interfere with the transmission and reception of signals. In particular, when the housing of the portable electronic device is made of an alloy such as aluminum combined with magnesium, the shielding phenomena are serious and problematic. Built-out antennas provide better transmission and reception of signals than built-in antennas. However, in most present-day portable electronic devices, the built-out antenna is located adjacent the earphone. There is some scientific research suggesting that frequent use of this kind of portable electronic device exposes the user's brain to much electromagnetic radiation which may be harmful.

A typical built-out antenna can be adjusted between an extended position and a retracted position. The built-out antenna is generally operated by hand. P.R. China Patent Application No. 99110465.X describes a built-out antenna for a mobile phone including a protrusion disposed on one end of the antenna. The protrusion extends out of a housing of the mobile phone. When needed, the antenna can be drawn out of the housing or pressed into the housing by operating the protrusion. However, both of these operations require the user to use both his/her hands together. If the user has only one hand free, he/she cannot operate the antenna. In addition, the protrusion may be unduly thick, which may detract from the aesthetic appearance of the mobile phone.

To solve the above-mentioned problem, some manufacturers utilize electric power to drive the antenna. A mobile phone with this kind of antenna is disclosed in P.R. China Patent Application No. 99802898.3. The antenna has a driving mechanism connected with the electric power source of the mobile phone. The antenna is extended out of the housing by the driving mechanism, and retracted back into the housing by the driving mechanism. However, it is generally necessary for the mobile phone to have an enhanced electric power source. In addition, the driving mechanism is complicated and bulky, and adds to an overall size of the mobile phone. Furthermore, the power consumption of the mobile phone is increased, which adds to the cost of owning the mobile phone.

Therefore, a new antenna device is desired in order to overcome the above-described problems.

SUMMARY OF THE INVENTION

Accordingly, an object of the present invention is to provide an automatic antenna for a portable electronic device which has a relatively simple configuration and convenient operation.

Another object of the present invention is to provide an automatic antenna for a portable electronic device which occupies a relatively small space of the portable electronic device.

To achieve the above-mentioned objects, an automatic antenna for a portable electronic device of the present invention is adapted to be used with a main body of the portable electronic device. The main body comprises an antenna holder and an antenna groove. The automatic antenna comprises a shaft having an end key, a securing element defining a hole, a hollow sliding element having a plurality of sliding arms symmetrically disposed on an outer wall thereof, a hollow rotating element, a housing, and a spring disposed between the rotating element and the housing. The securing element has a plurality of blocks symmetrically disposed on an inner wall thereof. The blocks define a plurality slots therebetween. Each block defines a recess. The sliding element defines an end surface having peaks. The rotating element includes a peripheral cam portion. The cam portion has a cam surface movably engaging with the peaks of the sliding element, and a plurality of projections protruding from a periphery of the cam portion. The shaft extends through the securing element, the sliding element, the rotating element, the spring and the housing in that order. The sliding arms can slide within the slots and recesses, and the projections can slide in the slots. When the antenna is in a retracted position, the projections are our of the slots, the spring biases the cam surface against the peaks of the sliding element so that the rotating element has a tendency to rotate, and the projections are blocked from rotating by the blocks.

In use of the antenna, the shaft is pressed down and drives the sliding element. The sliding element pushes the rotating element, with the peaks of the sliding element pushing the cam surface of the rotating element. The sliding arms slide within the slots and the recesses, and corresponding sliding arms push the projections of the rotating element out of the slots. Then the rotating element immediately rotates, with the spring driving the cam surface to ride along the peaks of the sliding element. At this time, the shaft is released. The spring drives the rotating element to continue rotating, with the cam surface riding onto and along ends of the blocks. The projections reach corresponding slots, and the spring drives the rotating element so that the projections slide into the slots. The rotating element pushes the sliding element, and the sliding element pushes the key of the shaft to be exposed out of the securing element. In this position, the projections are latched in the slots. The user can then grasp the key and pull the shaft up and out from the securing element a desired distance.

Other objects, advantages and novel features of the invention will become more apparent from the following detailed description when taken in conjunction with the accompanying drawings, in which:

DETAILED DESCRIPTION OF THE INVENTION

Figure 1:
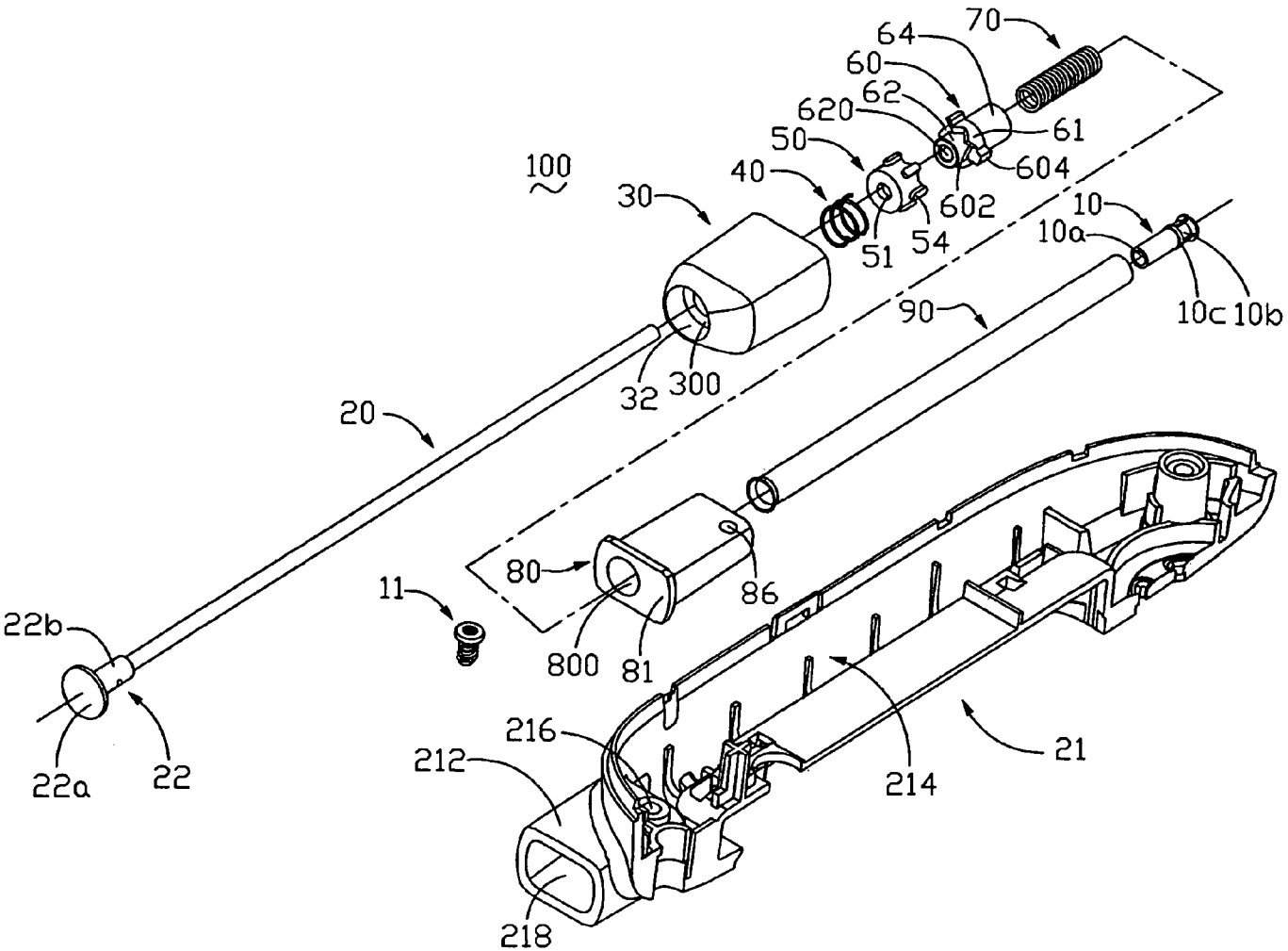
FIG. 1 is an exploded, isometric view of an automatic antenna in accordance with a preferred embodiment of the present invention, and part of a body of an associated portable electronic device.
Figure 2:
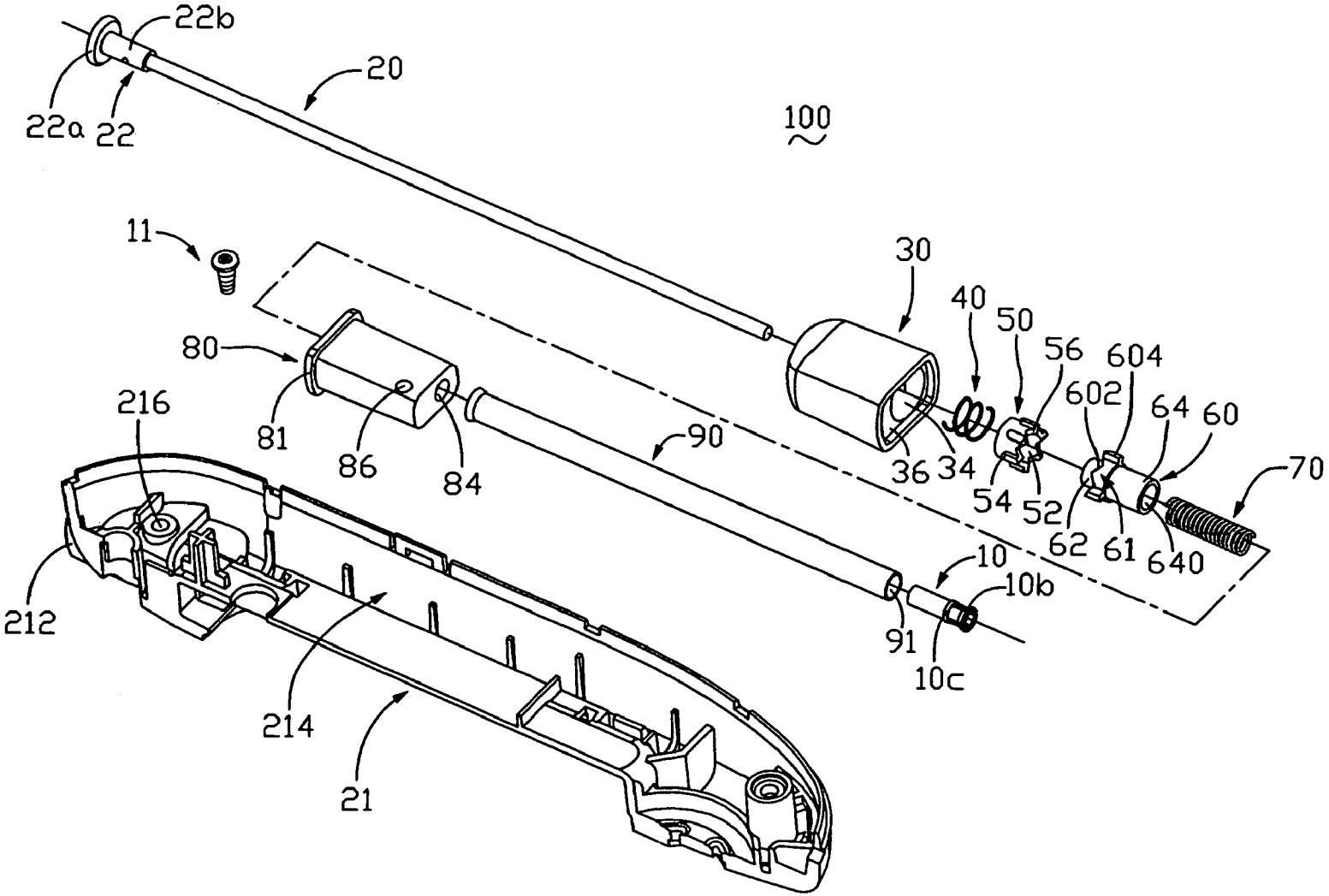
FIG. 2 is similar to FIG. 1, but viewed from another aspect.

Referring now to the drawings in detail, FIGS. 1 and 2 show a mechanism of an automatic antenna 100 for a portable electronic device (not shown). The antenna 100 comprises a shaft 20 as an antenna body, a securing element 30, two springs 40, 70, a sliding element 50, a rotating element 60, a housing 80, a sleeve 90, a pin 10, and a screw 11.

A body 21 (only partly shown) of a mobile phone using the antenna 100 has an antenna holder 212 at a top end thereof, and an antenna groove 214 along one side thereof to provide a receiving space for the antenna 100. The antenna holder 212 extends from the top end of the body 21. The antenna holder 212 defines a generally rectangular chamber 218 therein, and a restricting hole 216 in a bottom end thereof. The antenna groove 214 is adjacent to one sidewall of the body 21, and extends from the bottom end of the antenna holder 212 to a bottom end of the body 21.

The shaft 20 is long and cylindrical, and has a key 22 at a top end thereof. The key 22 comprises a cylindrical resisting portion 22*b*, and a discoid operating portion 22*a* at a top end of the resisting portion 22*b*.

Figure 4:
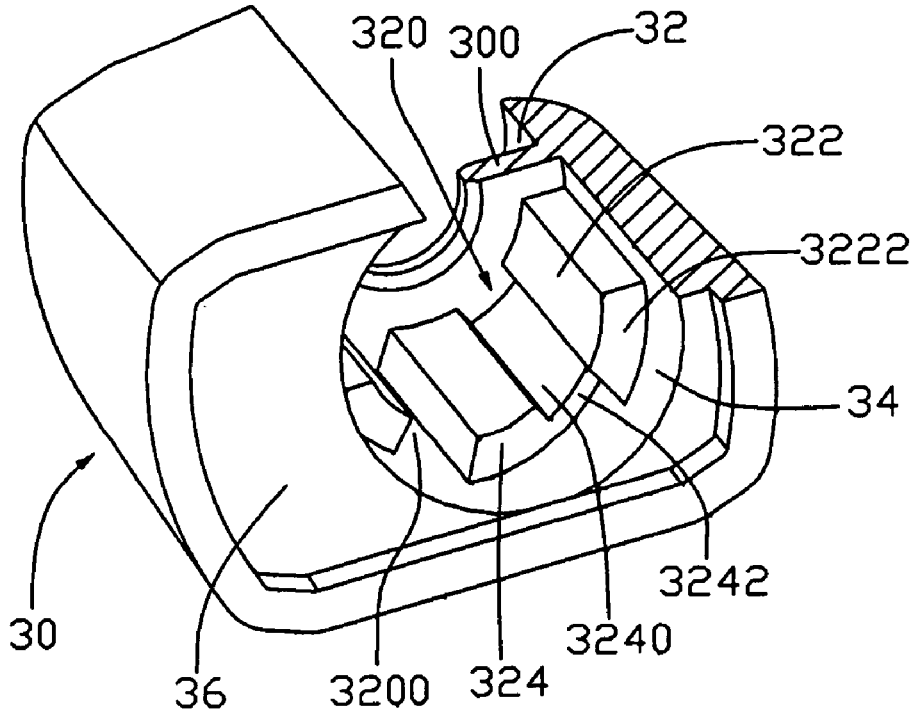
FIG. 4 is an enlarged, cut-away view of a securing element of the automatic antenna shown in FIG. 2.
Figure 5:
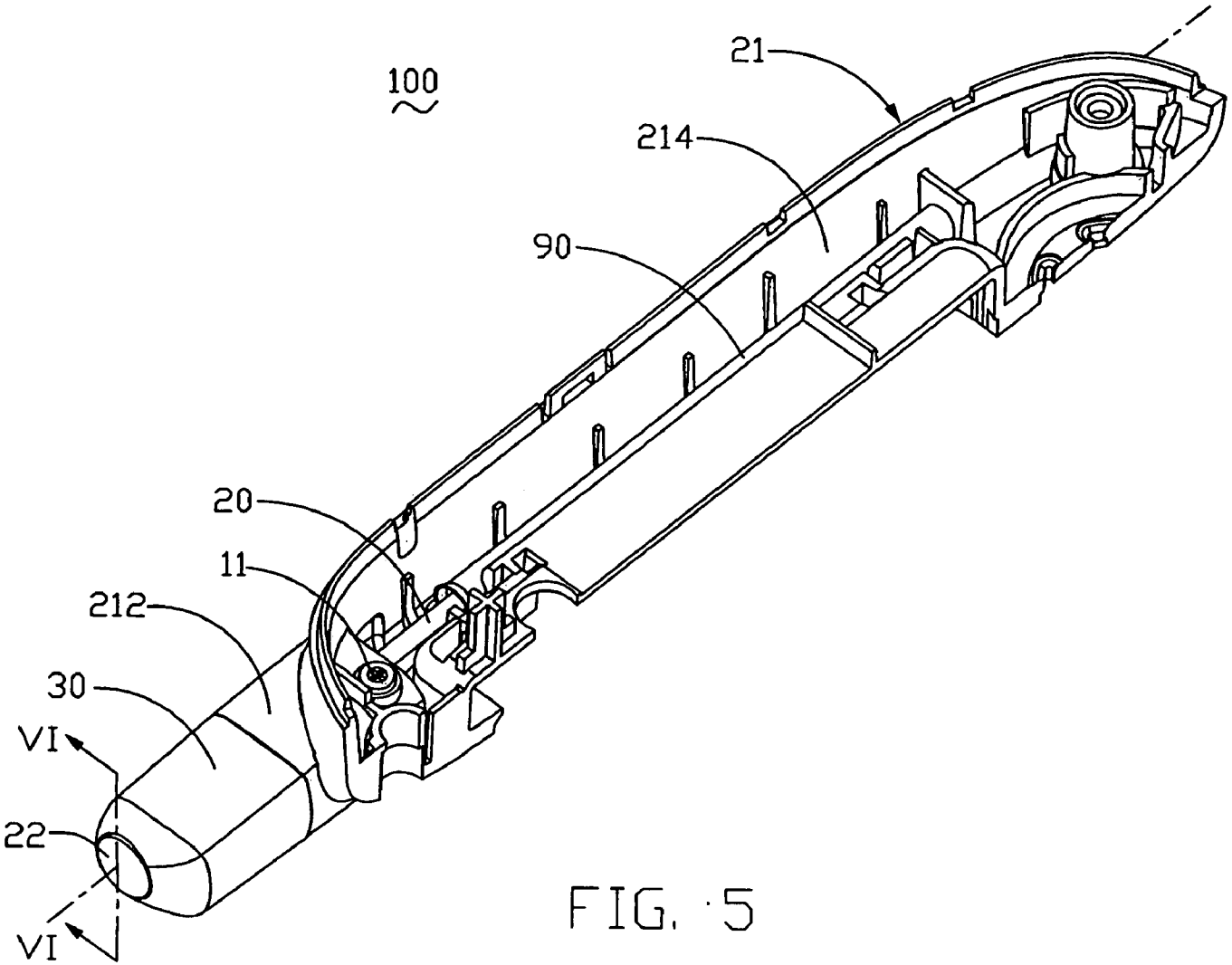
FIG. 5 is an assembled view of FIG. 1.

Referring also to FIG. 4, the securing element 30 is substantially a hollow cylinder. A configuration of a main body of the securing element 30 matches that of the antenna holder 212. The securing element 30 defines a hole (not labeled) therethrough. A partition 300 extends from an inner peripheral wall of the securing element 30 at the hole, thereby dividing the hole into: (i) a keyhole 32 for receiving the operating portion 22*a* of the shaft 20; and (ii) a receiving hole 34 for receiving the spring 40 and the sliding element 50. The securing element 30 further defines an enlarged, shallow outer opening 36 at the receiving hole 34. The keyhole 32, the receiving hole 34 and the outer opening 36 are in communication with each other, in that order from top to bottom. Three blocks 320 as lock means are provided on an inner peripheral wall of the securing element 30 in the receiving hole 34. The blocks 320 are evenly spaced apart from each other, and cooperatively define three slots 3200 therebetween. Each block 320 includes a first protrusion 322 and a second protrusion 324. The second protrusion 324 defines a recess 3240 adjacent the first protrusion 322. The first protrusion 322 is longer than the second protrusion 324, and the first protrusion 322 is thicker than the second protrusion 324. A bottom end of the first protrusion 322 has a first incline 3222, and a bottom end of the second protrusion 324 has a second incline 3242. The first incline 3222 slants radially outwardly and toward the bottom of the securing element 30. The second incline 3242 slants radially outwardly and toward the top of the securing element 30.

Figure 3:
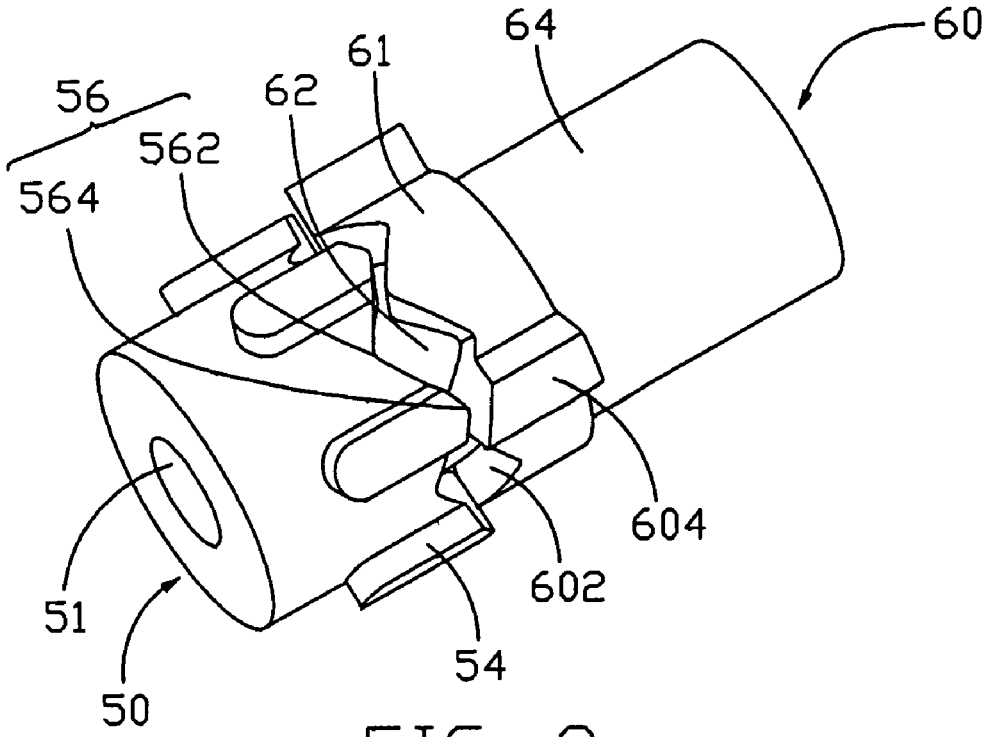
FIG. 3 is an enlarged, assembled view of a sliding element and a rotating element of the automatic antenna of FIG. 1.

Referring also to FIGS. 1–3, the sliding element 50 is substantially a hollow cylinder. The sliding element 50 comprises a hole 51 in a top end thereof, a cavity 52 in a bottom end thereof, six sliding arms 54 evenly spaced apart on a circumferential wall thereof, and an end surface 56. The sliding element 50 is received in the securing element 30, with the sliding arms 54 sliding into the slots 3200 and the recesses 3240. The end surface 56 comprises six valleys 562 and six peaks 564, the peaks 564 adjoining the sliding arms 54 respectively.

The rotating element 60 is substantially a hollow cylinder, and comprises a bottom portion 64, an enlarged, intermediate cam portion 61, and a reduced top portion 62. The cam portion 61 includes an undulating cam surface 602 at a front end thereof, corresponding to the end surface 56 of the sliding element 50. Three evenly spaced projections 604 are provided on a circumferential wall of the cam portion 61. The cam surface 602 engages with the end surface 56 of the sliding element 50, and the projections 604 can slide within the slots 3200 of the securing element 30. The top portion 62 defines a top hole 620, and the bottom portion 64 defines a bottom hole 640. A diameter of the top hole 620 is less than that of the bottom hole 640, thereby defining an annular inner step (not labeled) between the top hole 620 and the bottom hole 640. The top portion 62 is received in the cavity 52 of the sliding element 50.

Figure 6:
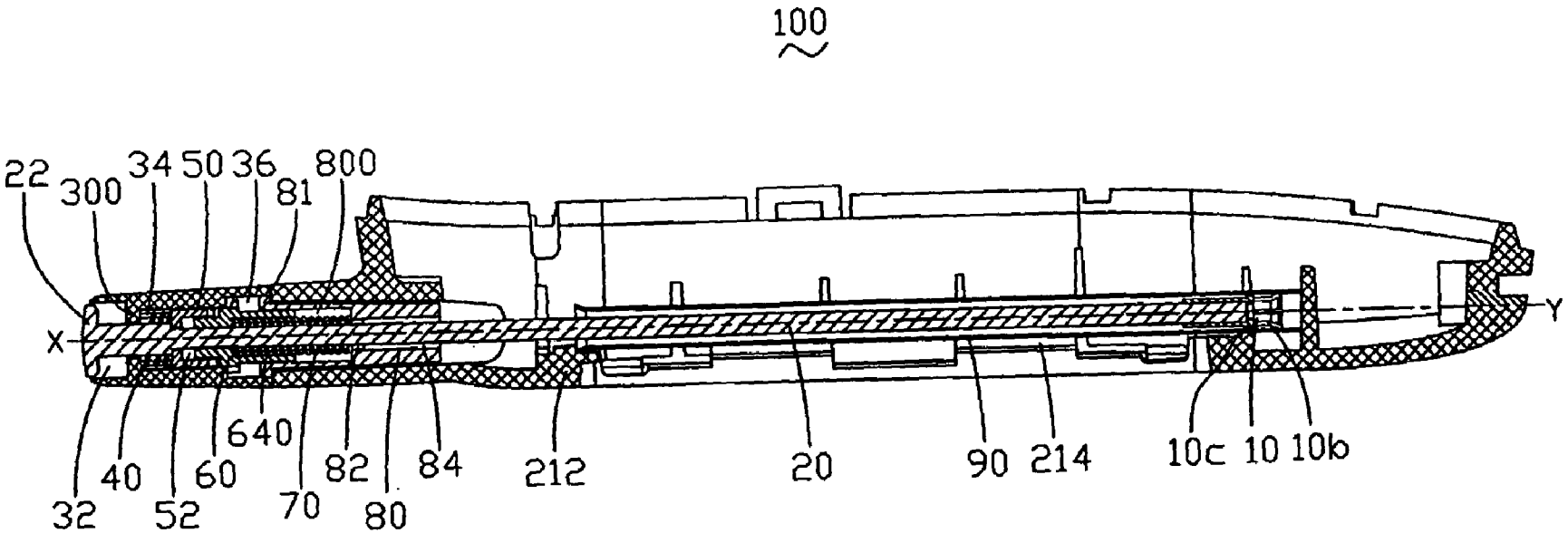
FIG. 6 is a cross-sectional view taken along line VI–VI of FIG. 5.

Referring also to FIG. 6, the housing 80 is substantially a step-like, hollow flattened cylinder. The housing 80 includes an enlarged, flat positioning head 81, which is locked in the outer opening 36 of the securing element 30. The housing 80 defines a top circular hole 800 for receiving the bottom portion 64 of the rotating element 60, an intermediate inner hole 82, and a bottom latch hole 84. The top hole 800, the inner hole 82 and the latch hole 84 are all coaxial with one another. A diameter of the top hole 800 is larger than that of the latch hole 84. The diameter of the latch hole 84 is larger than that of the inner hole 82, thereby defining an inner step where the inner hole 82 adjoins the latch hole 84. The diameter of the top hole 800 is larger than that of the inner hole 82, thereby defining an inner step where the inner hole 82 adjoins the top hole 800. The housing 80 also defines a positioning hole 86 in an outer wall thereof, perpendicular to the axis of the housing 80.

The sleeve 90 is a long, hollow cylinder received in the antenna groove 214 of the body 21.

The pin 10 is a hollow cylinder, and defines a top inserting hole 10*a*. The pin 10 has a plurality of elastic arms 10*b* at a bottom end thereof, and an exterior annular bead 10*c* formed adjacent the elastic arms 10*b*. The elastic arms 10*b* are furcated and slant slightly outwardly. The inserting hole 10*a* interferingly receives a bottom end of the shaft 20 therein, and the elastic arms 10*b* provide friction for the shaft 20 to be held in a desired position inside the sleeve 90.

The springs 40, 70 are metallic and helical. The spring 40 is received in the receiving hole 34 of the securing element 30 and located around the resisting portion 22*b* of the shaft 20. A top end of the spring 40 resists the partition 300 of the securing element 30. A bottom end of the spring 40 resists a top end of the sliding element 50, such that the end surface 56 of the sliding element 50 tightly engages with the cam surface 602 of the rotating element 60. The spring 70 is placed around the shaft 20, and a top portion of the spring 70 is received in the bottom hole 640 of the rotating element 60. One end of the spring 70 resists the inner step of the rotating element 60 where the top hole 620 adjoins the bottom hole 640. The other end of the spring 70 is received in the circular hole 800 of the housing 80, and resists the inner step of the housing 80 where the inner hole 82 adjoins the top hole 800.

In assembly, firstly, the spring 40, the sliding element 50 and the rotating element 60 are received in the securing element 30 in that order. The spring 40 and the sliding element 50 are received in the receiving hole 34, with the sliding arms 54 of the sliding element 50 being received in the slots 3200 and the recesses 3240. The spring 40 is thus engaged between the partition 300 and the sliding element 50. The top portion 62 of the rotating element 60 is inserted into the cavity 52 of the sliding element 50. The cam surface 602 of the rotating element 60 contacts the peaks 564 of the end surface 56 of the sliding element 50. The projections 604 abut against portions of the second inclines 3242 adjacent the recesses 3240 and contact the end surface 56 of the sliding element 50. Simultaneously, the projections 604 are stopped by the first protrusions 322 such that the rotating element 60 cannot rotate counterclockwise (as viewed from a bottom thereof). However, the rotating element 60 has a tendency to rotate counterclockwise (see below). The spring 70 is inserted into the bottom hole 640 of the rotating element 60 and abuts the inner step of the rotating element 60.

The housing 80 is inserted in the chamber 218 of the antenna holder 212. The screw 11 is inserted through the positioning hole 86 of the housing 80 and engaged in the restricting hole 216 of the antenna holder 212, so that the housing 80 is tightly secured in the antenna holder 212. The positioning head 81 abuts a top end of the antenna holder 212. The bottom portion 64 of the rotating element 60 is inserted in the hole 800 of the housing 80, such that the positioning head 81 of the housing 80 is received in the outer opening 36 of the securing element 30, and the securing element 30 abuts the top end of the antenna holder 212. The securing element 30 is then fixed on the antenna holder 212 by melting, ultrasonic welding or gluing. The sleeve 90 is received in the antenna groove 214 of the body 21. The shaft 20 is extended through the securing element 30, the spring 40, the sliding element 50, the rotating element 60, the spring 70, the housing 80 and the sleeve 90 in that order, with the resisting portion 22*b* of the key 22 of the shaft 20 abutting against the sliding element 30. The bottom end of the shaft 20 is inserted in the inserting hole 10*a* of the pin 10 such that the pin 10 is secured on the bottom end of the shaft 20. The shaft 20, the pin 10 and the sleeve 90 are electrically connected with a printed circuit board (not shown) of the mobile phone.

Referring also to FIG. 3 and FIG. 6, when the antenna 100 is in a retracted position, the key 22 is located in the keyhole 32 and the receiving hole 34 of the securing element 30, with the operating portion 22*a* located in a top of the keyhole 32. The peaks 564 of the end surface 56 of the sliding element 50 contact the cam surface 602 of the rotating element 60 under the cooperative forces of the springs 40, 70. Three peaks (not labeled) of the cam surface 602 that adjoin the projections 604 resist the end surface 56. The interference between the cam surface 602 and the end surface 56 is such that the rotating element 60 has a tendency to rotate counterclockwise (as viewed from the bottom thereof). Nevertheless, the rotating element 60 cannot rotate because the projections 604 are stopped by the first protrusions 322.

In use of the antenna 100, the operating portion 22*a* of the key 22 is pressed down, and the resisting portion 22*b* drives the sliding element 50 in the Y direction. The sliding element 50 drives the rotating element 60 in the Y direction, with the peaks 564 of the sliding element 50 pushing the cam surface 602 of the rotating element 60. The sliding arms 54 slide within the slots 3200 and the recesses 3240, and three of the sliding arms 54 push the projections 604 away from the second inclines 3242 until the projections 604 reach positions below the first inclines 3222. Then the rotating element 60 immediately rotates counterclockwise, with the spring 70 driving the cam surface 602 to ride along the peaks 564 of the sliding element 50. The cam surface 602 rides from the peaks 564 to the first inclines 3222. At this time, the operating portion 22*a* is released. The interference between the cam surface 602 and the first inclines 3222 is such that the rotating element 60 has a tendency to rotate counterclockwise (as viewed from the bottom thereof). Thus the spring 70 drives the rotating element 60 to continue rotating counterclockwise, with the projections 604 of the rotating element 60 moving along the first inclines 3222 until the projections 604 reach the slots 3200. Then the spring 70 drives the rotating element 60 in the X direction, with the projections 604 sliding in the slots 3200. The rotating element 60 pushes the sliding element 50 in the X direction, and the sliding element 50 pushes the resisting portion 22*b* in the X direction. Thus the operating portion 22*a* is pushed out of the keyhole 32. In this position, the projections 604 of the rotating element 60 are latched in the slots 3200.

Then the user can grasp the operating portion 22*a* and pull the shaft 20 up and out from the securing element 30 a desired distance. The friction force of the elastic arms 10*b* in the sleeve 90 enable the pin 10 to be stably located in any position inside the sleeve 90. Thus the shaft 20 can be stably located in any desired position. When the shaft 20 is drawn out to a fully extended position, the pin 10 moves into the housing 80 and the bead 10*c* is stopped by the inner step of the housing 80 where the inner hole 82 adjoins the latch hole 84. Thus the shaft 20 cannot be withdrawn beyond the fully extended position, and cannot fall out of the securing element 30.

When the antenna 100 is no longer needed, the operating portion 22*a* is pushed down toward the securing element 30. When the operating portion 22*a* nears the keyhole 32, the resisting portion 22*b* contacts the sliding element 50 and drives the sliding element 50 in the Y direction. The sliding element 50 drives the rotating element 60 in the Y direction, with the peaks 564 of the sliding element 50 pushing the cam surface 602 of the rotating element 60. The sliding arms 54 slide within the slots 3200 and the recesses 3240, and three of the sliding arms 54 push the projections 604 out of the slots 3200. Then the rotating element 60 immediately rotates counterclockwise, with the spring 70 driving the cam surface 602 to ride along the peaks 564 of the sliding element 50. The cam surface 602 rides from the peaks 564 to the second inclines 3242. At this time, the operating portion 22*a* is located well within the top of the keyhole 32, and is released. The interference between the cam surface 602 and the second inclines 3242 is such that the rotating element 60 has a tendency to rotate counterclockwise (as viewed from the bottom thereof). Thus the spring 70 drives the rotating element 60 to continue rotating counterclockwise, with the projections 604 of the rotating element 60 moving along the second inclines 3242 until the projections 604 are stopped by the first projections 322. At this time, the operating portion 22*a* is still located within the top of the keyhole 32, the sliding element 50 and the rotating element 60 are located in their original positions along the X-Y axis, and the antenna 100 is once again in the retracted position.

From the above description, it will be apparent that the antenna 100 of the present invention has a relatively simple configuration which provides highly convenient operation of the operating portion 22*a* of the key 22.

It is believed that the present invention and its advantages will be understood from the foregoing description, and it will be apparent that various changes may be made thereto without departing from the spirit and scope of the invention or sacrificing all of its material advantages, the example hereinbefore described merely being a preferred or exemplary embodiment of the invention.

We claim:

1. An automatic antenna adapted for use with a main body of a portable electronic device, the main body comprising an antenna holder, the automatic antenna comprising:

a shaft having a key on one end thereof;

a securing element defining a hole, a plurality of blocks being symmetrically disposed on an inner wall of the securing element in the hole, the blocks defining a plurality of slots therebetween, each block defining a recess;

a sliding element including a plurality of sliding arms symmetrically disposed on an outer wall thereof, and an end surface having peaks;

a rotating element including a peripheral cam portion, the cam portion having a cam surface movably engaging with the peaks of the sliding element, a plurality of projections protruding from a periphery of the cam portion, a portion of the rotating element being received in the sliding element;

a housing, a portion of the housing being received in the securing element, and another portion of the housing adapted to be received in the antenna holder; and a first elastic element received in and between the rotating element and the housing;

wherein the shaft extends through the securing element, the sliding element, the rotating element, the first elastic element, and the housing in that order, with the key of the shaft abutting against the sliding element; and the sliding arms can slide within the slots and the recesses, and the projections can slide in the slots.

2. The automatic antenna as claimed in claim 1, further comprising a hollow, cylindrical sleeve, the sleeve being adapted to be received in an antenna groove of the main body.

3. The automatic antenna as claimed in claim 2, further comprising a pin, the pin defining an inserting hole and having a plurality of elastic arms on one end thereof and a bead, the pin being engaged around one end of the shaft, and the shaft with the pin being received in the sleeve.

4. The automatic antenna as claimed in claim 3, further comprising a second elastic element disposed between the securing element and the sliding element.

5. The automatic antenna as claimed in claim 1, wherein a partition protrudes from the inner wall of the securing element, thereby defining a keyhole and a receiving hole in the hole of the securing element, and the securing element defines an outer opening adjacent to the receiving hole.

6. The automatic antenna as claimed in claim 5, wherein the key is received in the keyhole.

7. The automatic antenna as claimed in claim 5, wherein each block comprises a first protrusion having a first incline on a bottom end thereof, and a second protrusion having a second incline on a bottom end thereof.

8. The automatic antenna as claimed in claim 7, wherein the cam surface of the rotating element can rotate along the first inclines of the first protrusions and the second inclines of the second protrusions.

9. The automatic antenna as claimed in claim 3, wherein the hole of the housing includes a top hole, an intermediate inner hole, a bottom latch hole, and a positioning hole, a diameter of the top hole is larger than that of the inner hole, and a diameter of the inner hole is less than that of the latch hole.

10. The automatic antenna as claimed in claim 9, wherein one end of the first elastic element is received in the bottom hole of the rotating element, and the other end of the first elastic element is received in the top hole of the housing.

11. The automatic antenna as claimed in claim 9, further comprising a fastener, the fastener extending through the positioning hole of the housing and being adapted to engage in the antenna holder, such that said other portion of the housing is secured in the antenna holder.

12. The automatic antenna as claimed in claim 11, wherein the fastener is a screw.

13. The automatic antenna as claimed in claim 1, wherein the rotating element defines a top hole and a bottom hole.

14. The automatic antenna as claimed in claim 13, wherein the sliding element further defines a hole and a cavity in communication with the hole, and a top portion of the rotating element is received in the cavity.

15. The automatic antenna as claimed in claim 1, wherein said portion of the housing received in the securing element is a positioning head adjoining a main body of the housing.

16. The automatic antenna as claimed in claim 1, wherein the securing element is adapted to be secured on the antenna holder by melting.

17. The automatic antenna as claimed in claim 1, wherein the securing element is adapted to be secured on the antenna holder by ultrasonic welding.

18. The automatic antenna as claimed in claim 1, wherein the securing element is adapted to be secured on the antenna holder by adhesive.

19. An automatic antenna adapted for use with a main body of a portable electronic device, the main body comprising an antenna holder, the automatic antenna comprising:

a shaft having a key on one thereof;

a securing element defining a hole, a plurality of blocks being symmetrically disposed on an inner wall of the securing element in the hole, the blocks defining a plurality of slots therebetween;

a sliding element including a plurality of sliding arms symmetrically disposed on an outer wall thereof, and an end surface having peaks;

a rotating element including a peripheral cam portion, the cam portion having a cam surface movably engaging with the peaks of the sliding element, and a plurality of projections protruding from a periphery of the cam portion, a portion of the rotating element being received in the sliding element;

a housing, a portion of the housing being received in the securing element, and another portion of the housing adapted to be received in the antenna holder; and an elastic element received in and between the rotating element and the housing;

wherein the shaft extends through the securing element, the sliding element, the rotating element, the elastic element, and the housing in that order, with the key of the shaft abutting the sliding element;

when the antenna is in a retracted position, the projections are out of the slots, the elastic element biases the cam surface against the peaks of the sliding element so that the rotating element has a tendency to rotate, and the projections are blocked from rotating by the blocks;

when the antenna is automatically extended, the sliding arms slide in the slots and drive the rotating element to a position where the projections are no longer blocked by the blocks, the rotating element rotates until the projections slidingly engage in the slots, the elastic element drives the rotating element to push the sliding element, and the sliding element pushes the key of the shaft to be exposed out of the securing element; and when the antenna is automatically retracted, the sliding arms slide in the slots and drive the rotating element to a position where the projections exit the slots, and the rotating element rotates until the projections are blocked by the blocks.

20. An antenna mechanism adapted for use with a portable electronic device having a space to receive said antenna mechanism, said antenna mechanism comprising:

an antenna body having a key at one end thereof, said antenna body being electrically connected with said portable electronic device as an agent of signal receiving for said portable electronic device, and movable between a first position for substantially fully exposing to an ambient circumstance around said portable electronic device, a second position for being fully received in said space and a third position for releasing thereof;

a movable element disposed in said space and attached by an elastic element to become resiliently movable in said space, said element being capable of accumulating resilient force with aid of said elastic element for moving said antenna body out of said space in case of movement of said antenna body from said first position to said second position, and releasing said resilient force on said antenna body in case of movement of said antenna body from said second position to said third position; and a lock means for securing said antenna body at said second position in case of movement of said antenna body from said first position to said second position;

said key of said antenna body being exposable to said ambient circumstance due to said resilient force in case of movement of said antenna body from said second position to said third position so as to allow movement of said antenna body from said second position to said first position.

21. The antenna mechanism as claimed in claim 20, wherein said element is rotary around said antenna body from a position of accumulating said resilient force to another position of releasing said resilient force.

22. The antenna mechanism as claimed in claim 20, further comprising a sliding element resiliently disposed in said space for contributorily controlling movement of said element.

23. The antenna mechanism as claimed in claim 20, further comprising a pin disposed on said antenna body and movable therewith in said space, said pin adapted to position said antenna body at any location between said first position and said second position thereof.

* * * * *

UNITED STATES PATENT AND TRADEMARK OFFICE

CERTIFICATE OF CORRECTION

PATENT NO. : 6,985,115 B2
DATED : January 10, 2006
INVENTOR(S) : Rui-Hao Chen et al.

It is certified that error appears in the above-identified patent and that said Letters Patent is hereby corrected as shown below:

Title page,
Item [73], Assignee, "FTH Co., Ltd." should read -- FIH, Co., Ltd. --.

Signed and Sealed this

Sixth Day of June, 2006

JON W. DUDAS
*Director of the United States Patent and Trademark Office*